US005447306A

United States Patent [19]

Selden

[11] Patent Number: 5,447,306

[45] Date of Patent: Sep. 5, 1995

[54] HOCKEY STICK ASSEMBLY

[76] Inventor: Scott C. Selden, P.O. Box 1472, Burnsville, Minn. 55377

[21] Appl. No.: 349,466

[22] Filed: Dec. 5, 1994

Related U.S. Application Data

[63] Continuation of Ser. No. 88,786, Jul. 8, 1993, abandoned.

[51] Int. Cl.[6] ..... A63B 59/14

[52] U.S. Cl. ..... 273/67 A

[58] Field of Search ..... 273/67 A, 80.1

[56] References Cited

U.S. PATENT DOCUMENTS

| | | | |
|---|---|---|---|
| 3,102,726 | 9/1963 | Barrett | 273/80.1 |
| 3,366,406 | 1/1968 | Morris . | |
| 3,638,942 | 2/1972 | Bassett . | |
| 3,811,455 | 5/1974 | Thur . | |
| 3,829,092 | 8/1974 | Arkin | 273/80.1 |
| 3,934,875 | 1/1976 | Easton | 273/67 A |
| 3,961,790 | 6/1976 | Milligan | 273/67 A |
| 4,253,666 | 3/1981 | Murphy | 273/80.1 |
| 4,358,113 | 11/1982 | McKinnon | 273/67 A |
| 4,361,325 | 11/1982 | Jansen . | |
| 4,488,721 | 12/1984 | Franck et al. . | |

FOREIGN PATENT DOCUMENTS

| | | | |
|---|---|---|---|
| 489072 | 12/1952 | Canada | 273/67 A |
| 705274 | 3/1965 | Canada . | |
| 847193 | 7/1970 | Canada . | |
| 253977 | 4/1948 | Switzerland . | |
| 427399 | 4/1935 | United Kingdom | 273/80.1 |

*Primary Examiner*—Mark S. Graham
*Attorney, Agent, or Firm*—Kinney & Lange

[57] ABSTRACT

A hockey stick assembly including a blade, a shaft, an intermediate shank, a pin and a spring-biased release member. The blade has a neck portion with an aperture extending through it. The intermediate shank includes a side wall, a release hole extending through the side wall and a pair of aligned pin holes extending through the side wall. The neck portion of the blade nests within the shank so that the aperture of the neck portion is coaxially aligned with the pair of aligned pin holes. The pin is inserted through the aligned pin holes and through the aperture to pin the blade to the shank. The shaft has a blade end and a handle end. The blade end includes a side wall, a cavity extending from the blade end towards the handle end and a shaft hole extending through the side wall. The intermediate shank nests within the cavity of the shaft so that the shaft overlaps the pin to lock the shank to the blade and so that the release hole of the shank is in coaxial alignment with the shaft hole. The spring-biased release member is carried within the shank. The release member includes a button biased so that the button extends through the release hole of the shank and through the shaft hole to secure the shank to the shaft and to secure the shaft to the blade.

21 Claims, 2 Drawing Sheets

HOCKEY STICK ASSEMBLY

This is a continuation of application Ser. No. 08/088,786, filed Jul. 8, 1993.

BACKGROUND OF THE INVENTION

The present invention relates to hockey stick assemblies having replaceable blades and replaceable shafts. In particular, the present invention relates to a hockey stick assembly having an intermediate shank which locks the shaft of the hockey stick to the replacement blade with a spring-biased release member.

Hockey sticks are subjected to a variety of stresses during the course of a hockey game. These stresses often produce undue wear on the blade portion of the stick to such an extent that a complete new hockey stick is necessary.

To eliminate the need for replacing the entire hockey stick, hockey stick assemblies have been designed so that only the damaged blade portion of the hockey stick need be replaced. However, replacing the damaged blade portion has been both time consuming and expensive. With one such hockey stick assembly, the shank and the replaceable blade are molded as a unitary structure and are fabricated from thermoplastic, polymeric material. The shaft of the hockey stick is joined to the replaceable blade and to the shank by heating the shank and inserting the shaft into a socket of the shank. Upon cooling, the shank sets rigidly and grips tightly onto the shaft.

With another hockey stick assembly, the blade of the hockey stick is secured to an aluminum shaft by a hot melt glue. This creates a number of problems for those who do not have the right equipment to heat up the shaft and the blade or the right equipment to work with the glue. Both of above hockey stick assemblies require expensive equipment to heat up either the shaft or the blade in order to secure the blade to the shaft. Moreover, replacing the damaged blade portion on both hockey stick assemblies requires time for heating up either the glue or the shank and allowing the heated material to then cool. This duration of time prevents the replacement of the damaged blade portion during a hockey game. As a result, several hockey sticks must be kept on hand.

SUMMARY OF THE INVENTION

The present invention is an improved hockey stick assembly. The hockey stick assembly includes a blade, a shaft, an intermediate shank, a pin and a spring-biased release member. The blade has a neck portion with an aperture extending through it. The intermediate shank includes a side wall, a release hole extending through the side wall and a pair of aligned pin holes extending through the side wall. The neck portion of the blade nests within the shank so that the aperture of the neck portion is coaxially aligned with the pair of aligned pin holes. The pin is inserted through the aligned pin holes and through the aperture to pin the blade to the shank. The shaft has a blade end and a handle end. The blade end includes a side wall, a cavity extending from the blade end towards the handle end and a shaft hole extending through the side wall. The intermediate shank nests within the cavity of the shaft so that the shaft overlaps the pin to lock the shank to the blade and so that the release hole of the shank is in coaxial alignment with the shaft hole. The spring-biased release member is carried within the shank. The release member includes a button biased so that the button extends through the release hole of the shank and through the shaft hole to secure the shank to the shaft and to secure the shaft to the blade. As a result, the present invention permits the blade to be quickly and easily replaced or repaired if damaged.

DETAILED DESCRIPTION OF THE PREFERRED EMBODIMENTS

Figure 1:
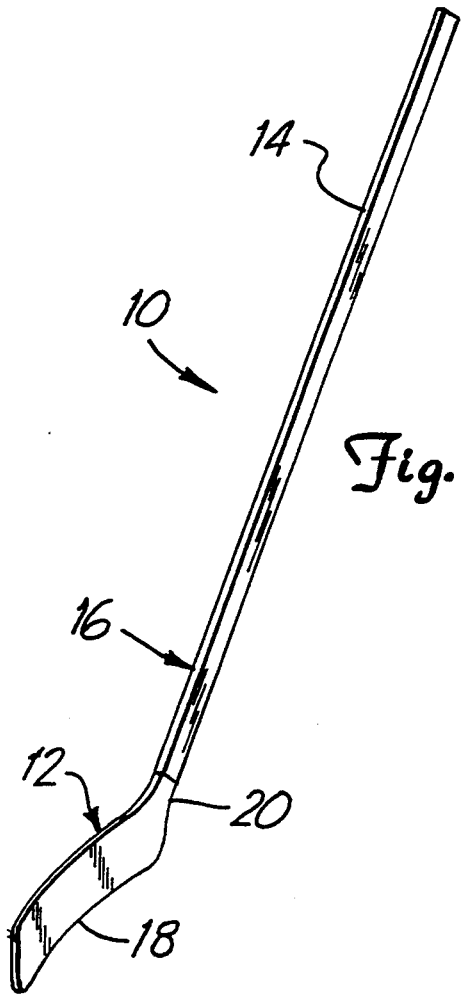
FIG. 1 is a perspective view of a hockey stick assembly of the present invention.

FIG. 1 is a perspective view of hockey stick assembly 10 upon assembly. Hockey stick assembly 10 generally includes blade 12, shaft 14 and coupling mechanism 16. Blade 12 includes a main blade-body portion 18 and a neck portion 20. Neck portion 20 integrally extends away from blade-body portion 18 at an angle. Shaft 14 is generally elongate and is mounted to blade 12 adjacent neck portion 20 by coupling mechanism 16. Coupling mechanism 16 protrudes through shaft 14. As a result, coupling mechanism 16 is manually actuable for unlocking and releasing shaft 14 from blade 12.

Figure 2:
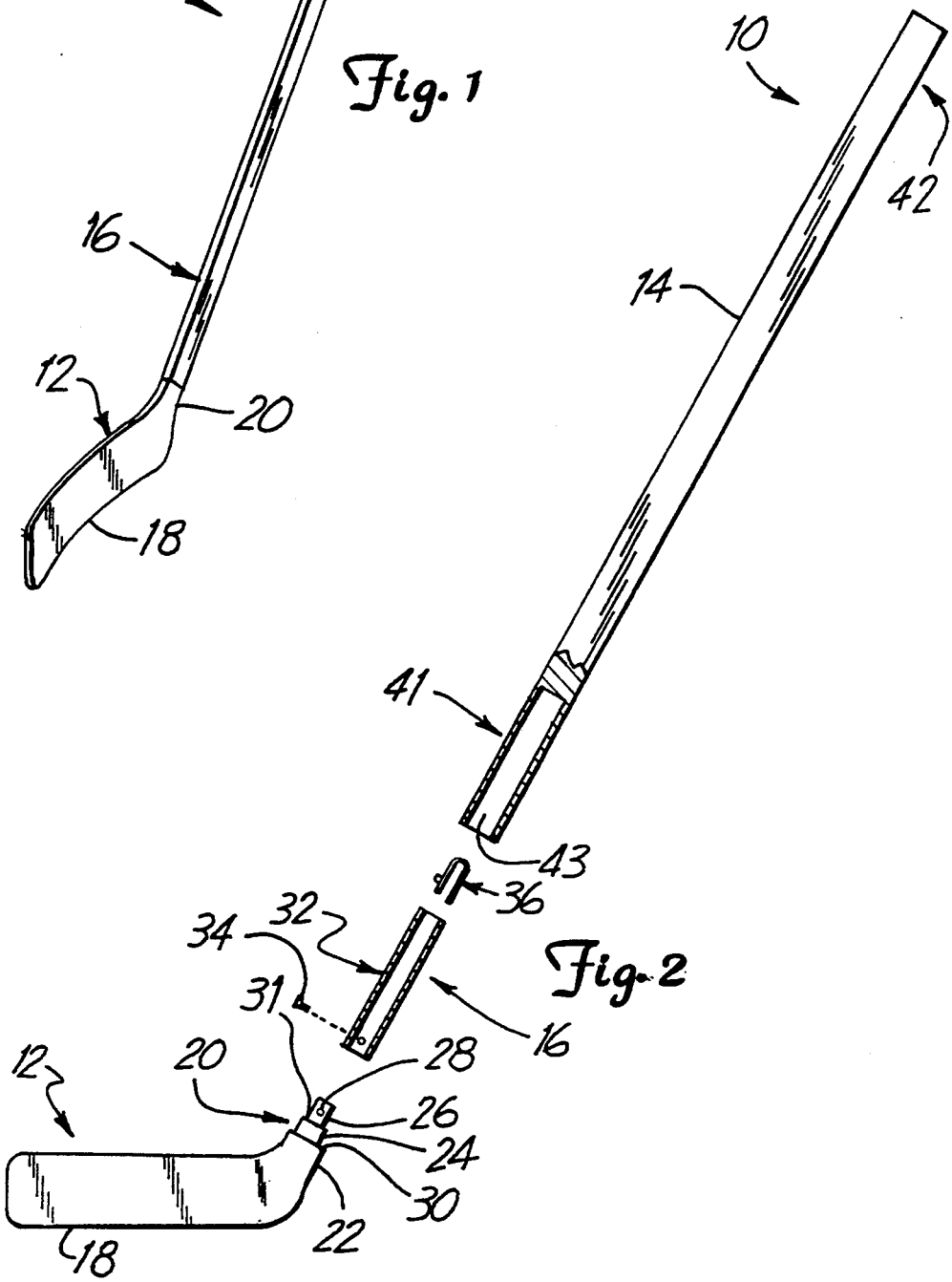
FIG. 2 is an exploded fragmentary cross-sectional view of the hockey stick assembly of FIG. 1.

FIG. 2 is an exploded view of hockey stick assembly 10. Coupling mechanism 16 and shaft 14 are additionally shown in cross-section. FIG. 2 shows blade 18, coupling mechanism 16 and shaft 14 in further detail. As best shown in FIG. 2, neck portion 20 of blade 18 includes base 22, lower lug 24, upper lug 26 and aperture 28. Base 22 integrally extends away from blade body portion 18. Lower lug 24 integrally extends away from base 22. Base 22 has an outer perimeter which narrows to form lower lug 24 and shoulder 30. Lower lug 24 has an outer perimeter which narrows toward a top end of lug 24 to form upper lug 26 and shoulder 31. Aperture 28 extends through upper lug 26.

Coupling mechanism 16 includes intermediate shank 32, pinning mechanism 34 and spring-biased release member 36. Intermediate shank 32 is a generally elongated hollow rectangular tube. Shank 32 is preferably formed from aluminum. Alternatively, shank 32 is formed from plastic. Pinning mechanism 34 preferably comprises a pin. However, any mechanism used to pin two objects together, such as bolts or screws, may also be used. Spring-biased release member 36 preferably comprises a leaf spring made of aluminum. Spring-biased release member 36 is sized to fit within intermediate shank 32.

Shaft 14 is elongated and includes blade end 41, a handle end 42 and central bore or cavity 43. Cavity 43 extends into blade end 41 of shaft 14. Cavity 43 is sized to accommodate intermediate shank 32, upper lug 26 and lower lug 24.

Figure 3:
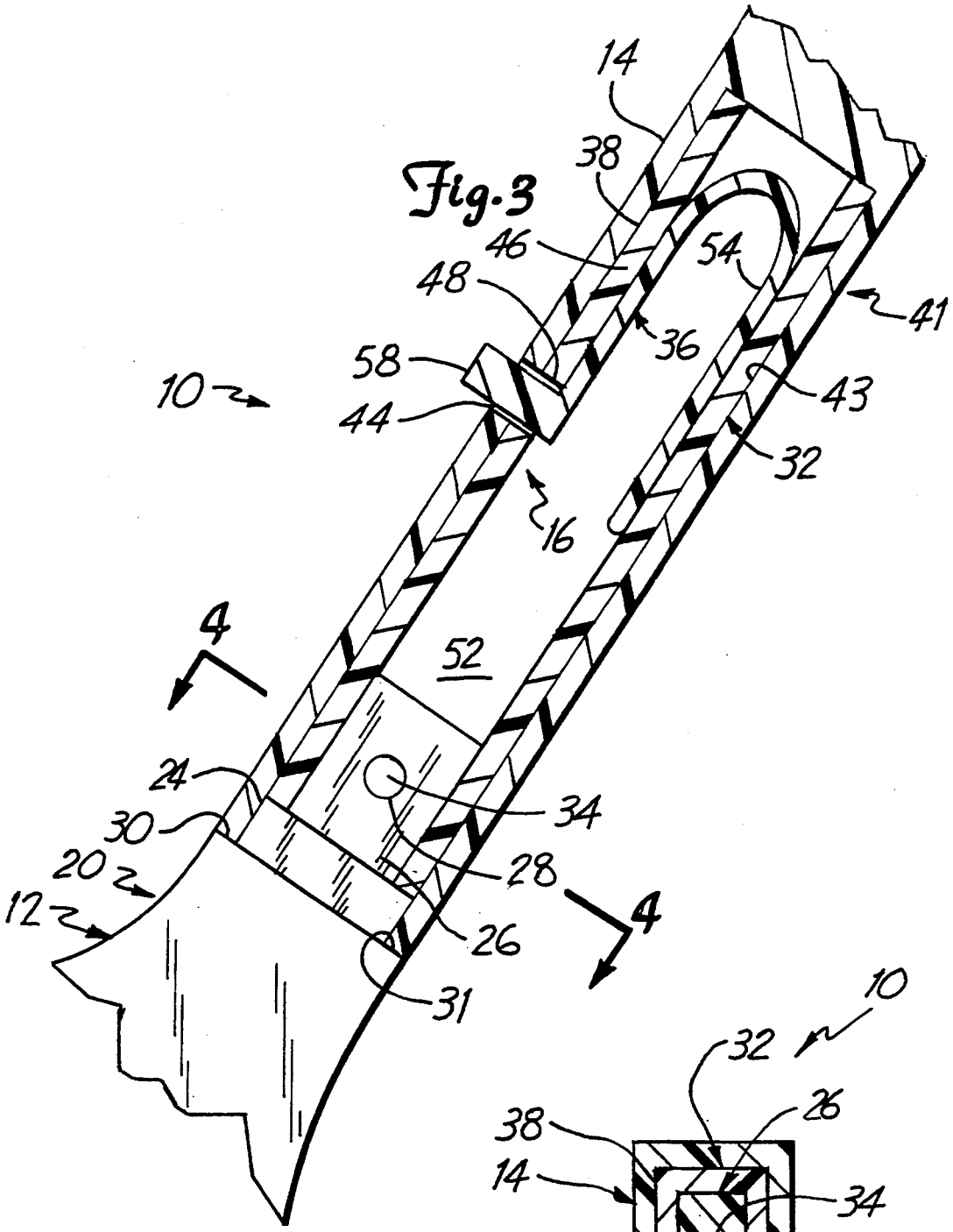
FIG. 3 is a fragmentary cross-sectional view of the hockey stick assembly of FIG. 2.
Figure 4:
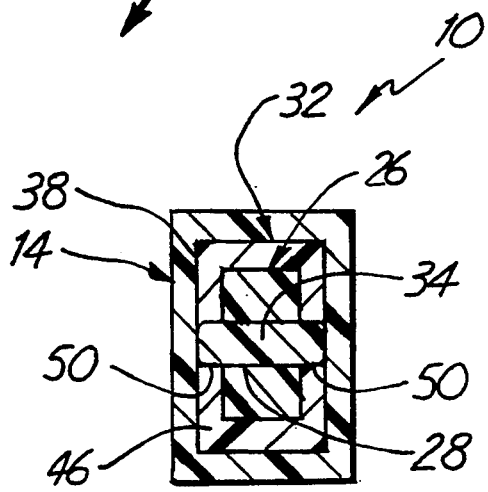
FIG. 4 is a cross-sectional view of the hockey stick assembly of FIG. 3 taken along line 4—4.

FIGS. 3 and 4 show neck portion 20, blade end 41 of shaft 14 and coupling mechanism 16 assembled together in greater detail. FIG. 3 is a longitudinal cross-sectional view of shaft 14 coupled to blade 12 by coupling mechanism 16. FIG. 4 is a cross-sectional view of hockey stick assembly 10 shown in FIG. 3 taken along line 4—4 of FIG. 3.

As best shown by FIG. 3, blade end 41 of shaft 14 includes cavity 43 and shaft hole 44. Cavity 43 extends into blade end 41 of shaft 14. Cavity, 43 has an inner diameter approximately the same as an outer diameter of lower lug 24 of neck portion 20. Preferably, blade end 41 of shaft 14 has an outer surface having approximately the same diameter as an outer surface diameter of base 22 of neck portion 20. As a result, blade end 41 of shaft 14 engages shoulder 30 and lower lug 24 of neck portion 20 to form a smooth, continuous junction between blade 12 and shaft 14 so that the outer surface of blade end 41 is contiguous with the outer surface of base 22 of neck portion 20. Because lower lug 24 nests within blade end 41, the junction between shaft 14 and blade 12 is rigidified and made stronger.

In addition, cavity 43 of blade end 41 has a sufficient inner diameter to permit intermediate shank 32 to be positioned within cavity 43 partially between upper lug 26 and shaft 14. Thus, the juncture between blade 12 and shaft 14 is further rigidified by intermediate shank 32 positioned within cavity 43 of blade end 41.

Coupling mechanism 16 includes intermediate shank 32, pinning mechanism 34 and spring-biased release member 36. Intermediate shank 32 is a generally elongated hollow rectangular tube and includes side wall 46, release hole 48 and a pair of coaxially aligned pinholes 50. Side wall 46 forms a hollow rectangular tube and defines hollow interior 52. Interior 52 has an inner diameter approximately the same as an outer diameter of upper lug 26 of neck portion 20. Preferably, the lower end of intermediate shank 32 has an outer diameter approximately the same as an outer diameter of lower lug 24.

Upon assembly, upper lug 26 nests within interior 52 of intermediate shank 32. Intermediate shank 32 engages upper lug 26 and shoulder 31 of neck portion 20 to form a smooth, continuous junction between blade 12 and intermediate shank 32 so that an outer surface of lower lug 24 is contiguous with an outer surface of intermediate shank 32. The smooth, continuous junction between lower lug 24 and intermediate shank 32 permits blade end 41 of shaft 14 to be quickly and easily positioned across the junction between lower lug 24 and intermediate shank 32. Moreover, because upper lug 26 nests within interior 52 of intermediate shank 32, the junction between intermediate shank 32 and blade 12, and between shaft 14 and blade 12, is rigidified and made stronger.

Release hole 48 extends from hollow interior 52 through side wall 46. Pinholes 50 extend through side wall 46 and are in coaxial alignment with one another. Preferably, pinholes 50 are oriented at 90 degrees with respect to release hole 48. Pinholes 50 are sized to accommodate pinning mechanism 34 so that pinning mechanism 34 may be inserted through pinholes 50 and aperture 28 to couple intermediate shank 32 to neck portion 20 of blade 12.

Spring-biased release member 36 consists of a leaf spring and includes spring member 54 and push button 58. Spring member 52 is arcuately curved and preferably comprises a substantially V or U-shaped leaf spring. Spring member 54 provides a spring-biased force to push button 58. Button 58 extends upward from spring member 54. Spring-biased release member 36 is a single, separate component completely carried within interior 52 of intermediate shank 32. As a result, shaft 14 and coupling mechanism 16 are less complex, are more easily manufactured and are more easily assembled.

Coupling mechanism 16 releasably secures shaft 14 to blade 12. As best shown by FIG. 3, spring-biased release member 36 releasably secures shaft 14 to intermediate shank 32. Intermediate shank 32 fits within cavity 43 of shaft 14 so that release hole 48 and shaft hole 44 are in coaxial alignment with one another. Spring-biased release member 36 is completely carried within interior 52 of intermediate shank 32. Spring member 54 presses against side wall 46 within interior 52 to force button 58 through release hole 48 and shaft hole 44. Consequently, button 58 releasably couples intermediate shank 32 to shaft 14. Button 58 protrudes above shaft 14 so that button 58 is manually actuable for unlocking shaft 14 from shank 32. As a result, shaft 14 may be easily detached from blade 12 and intermediate shank 32 so that blade 12 may be quickly and easily replaced or repaired if damaged.

As best shown by FIG. 4, intermediate shank 32 is coupled to neck portion 20 of blade 12 by pinning mechanism 34. Pinning mechanism 34 is inserted through pinholes 50 and through aperture 28 of upper lug 26 to couple intermediate shank 32 to upper lug 26. Shaft 14 extends over intermediate shank 32 and over lower lug 24 to lock pinning mechanism 34 within aperture 28 and pinholes 50.

Upon compression of button 58 of spring-biased release member 36, shaft 14 may be separated from blade 12 and intermediate shank 32. As a result, pinning mechanism 34 may be removed from aperture 28 and pinholes 50 to uncouple intermediate shank 32 from blade 12. Thus, upon simple manual compression of button 58, blade 12 is uncoupled from shaft 14 so that blade 12 may be replaced. The replacement of blade 12 can be performed without specialized heating tools or equipment and in less time.

Preferably, shank 32 has a length of about 7.75 inches, a width of 0.615 inches and a height of about 1.025 inches. Pin holes 50 have a diameter of about 0.257 inches and are centered along the height of shank 32. Pin holes 50 have a center which is located about 1.062 inches from an end of shaft 14 and about 0.512 inches from an edge of shaft 14. Hole 56 preferably has a diameter of about 0.25 inches. Hole 56 has a center preferably positioned about 4.312 inches from the end of shaft 14 and about 0.304 inches from an edge of side wall 38 of shank 32. Preferably, side wall 46 has a material thickness of about 0.062 inches.

In conclusion, the hockey stick assembly of the present invention permits the blade of the hockey stick to be quickly and less expensively replaced or repaired. Simple manual compression of push button 58 uncouples shaft 14 from blade 12. The uncoupling of shaft 14 from blade 12 releases pinning mechanism 34 and also permits intermediate shank 32 to separate from blade 12. Consequently, a new blade or a repaired blade may be quickly and easily reattached to intermediate shank 32 and to blade 14.

At the same time, the hockey stick assembly of the present invention provides a rigid and strong, but smooth, junction between shaft 14 and replaceable blade 12. Because lower lug 2,4, upper lug 26 and intermediate shank 32 are inter-nested within shaft 14, the juncture between shaft 14 and blade 12 is rigid and strong. Consequently, this juncture is more likely to endure the variety of stresses during the course of a hockey game. Because the juncture between blade 12 and shaft 14 is smooth and contiguous, the juncture is less noticeable and is less likely to be caught on other surfaces.

Yet another advantage of the hockey stick of the present invention is that the hockey stick assembly may be manufactured and assembled at a lower cost and in less time. Because spring-biased release member 36 is a single, separate component completely carried within interior 52 of intermediate shank 32, shaft 14, intermediate shank 32 and blade 12 do not require complex attachment structures or components. As a result, shaft 14, intermediate shank 32 and blade 12 are more easily and economically manufactured. In addition, shaft 14, intermediate shank 32 and blade 12 are more easily assembled.

As can be appreciated, blade 12 and shaft 14 may have a variety of shapes and may be made from a variety of materials. Furthermore, in lieu of pinning mechanism 34, hot melt glue may be used to couple shank 32 to blade 12. Alternatively, shank 32 may be integrally formed as part of blade 12.

Although the present invention has been described with reference to preferred embodiments, workers skilled in the art will recognize that changes may be made in form and detail without departing from the spirit and scope of the invention.

What is claimed is:

1. A hockey stick assembly, the hockey stick assembly comprising:

a blade having a main blade body portion and a neck portion;

a shaft having an outer surface, a blade end and a handle end, the blade end having a side wall, a central bore extending from the blade end towards the handle end and a shalt hole extending through the side wall;

an intermediate shank having a shank sidewall with an outer diameter, an interior defined by the shank side wall and a release hole extending through the shank side wall, wherein the intermediate shank and the shaft are in a nested relationship so that the release hole of the shank is in coaxial alignment with the shaft hole;

means for releasably attaching the intermediate shank to the neck portion of the blade; and a spring-biased release member within the interior of the shank and within the central bore of the shaft, the release member including a button biased so that the button extends through the release hole of the shank and through the shaft hole to releasably secure the shank to the shaft.

2. The assembly of claim 1 wherein the neck portion includes an aperture extending through the neck portion, wherein the shank further includes a pair of coaxially aligned pin holes in coaxial alignment with the aperture and wherein the means for attaching comprises a pinning mechanism for insertion through the aperture and the through the coaxially aligned pin holes to couple the shank to the neck portion of the blade.

3. The assembly of claim 1 wherein the neck portion nests within the interior of the shank to engage the shank.

4. The hockey stick assembly of claim 2 wherein the release hole is circumferentially spaced at about 90° from the pin holes.

5. The hockey stick assembly of claim 1 wherein the button of the spring-biased release member protrudes above the shaft so that the button is manually actuable for unlocking the shaft from the shank.

6. The hockey stick assembly of claim 1 wherein the spring-biased release member further includes a substantially U-shaped release spring for biasing the button so that the button extends through the release hole of the shank and through the shaft hole to releasably secure the shank to the shaft.

7. The hockey stick assembly of claim 1 wherein the neck portion has an outer surface and a lower lug protruding from the neck portion, wherein the lower lug nests within the central bore of the shaft so that the outer surface of the neck portion is contiguous with the outer surface of the shaft.

8. The hockey stick assembly of claim 7 wherein the neck portion further includes an upper lug protruding form the lower lug, wherein the upper lug nests within the interior of the intermediate shank so that the outer diameter of the intermediate shank is contiguous with the lower lug.

9. A hockey stick assembly, the hockey stick assembly comprising:

a shaft having a blade end and a handle end, the blade end having a side wall, an outer surface, a central bore extending from the blade end towards the handle end and a shaft hole extending through the side wall;

a blade having a main blade body portion and a neck portion, the neck portion having an outer surface and a lug protruding from the neck portion, wherein the lug nests within the central bore of the shaft so that the outer surface of the shaft is contiguous with the outer surface of the neck portion;

an intermediate shank coupled to the neck portion and positioned within the central bore of the shaft; a pin extending through the shank and through the neck portion of the blade to couple the intermediate shank to the neck portion of the blade, wherein the Shaft overlaps the pin to lock the pin in position; and a spring-biased release member carried within the central bore of the shaft, the release member including a button biased so that the button extends through the shank and through the shaft to releasably secure the shank to the shaft.

10. The hockey stick assembly of claim 9 wherein the spring-biased release member further includes it substantially U-shaped spring for biasing the button so that the button extends through the shank and through the shaft to releasably secure the shank to the shaft.

11. The hockey stick assembly of claim 9 wherein the button of the spring-biased release member protrudes above the shaft so that the button is manually actuable for unlocking the shaft from the shank.

12. The assembly of claim 9 wherein the intermediate shank further includes an interior and a pair of coaxially aligned pin holes, wherein the neck portion nests within the interior of the shank and includes an aperture extending through the neck portion, and wherein the pin extends through the aperture and through the pair of aligned pin holes to couple the shank to the neck portion.

13. The hockey slick assembly of claim 12 wherein the spring-biased release member is circumferentially spaced at about 90 degrees from the pair of coaxially aligned pinholes.

14. A hockey stick assembly, the hockey stick assembly comprising:

a blade having a main blade-body portion and a neck portion, the neck portion having an aperture extending through the neck portion;

an intermediate shank releasably pinned to the blade, the shank comprising a side wall, a release hole extending through the side wall, and a pair of aligned pin holes extending through the side wall, wherein the neck portion of the blade nests within the shank so that the aperture of the neck portion is coaxially aligned with the pair of aligned pin holes;

a pin inserted through the aligned pin holes and through the aperture so as to pin the blade to the shank;

a shaft having a blade end and a handle end, the blade end having a blade side wall, a cavity extending from the blade towards the handle end and a shaft hole extending through the blade side wall, wherein the shank nests within the cavity of the shaft so that the shaft overlaps the pin to lock the shank to the blade and so that the release hole of the shank is in coaxial alignment with the shaft hole of the shaft; and a spring-biased release member carried within the shank, the release member including a button biased so that the button extends through the release hole of the shank and through the shaft hole to secure the shank to the shaft and to secure the shaft to the blade.

15. The hockey stick assembly of claim 14 wherein the release hole is circumferentially spaced at about 90° from the pinholes.

16. The hockey stick assembly of claim 14 wherein the button of the spring-biased release member protrudes above the shaft so that the button is manually actuable for unlocking the shank from the shaft.

17. The hockey stick assembly of claim 14 wherein the spring-biased release member further includes substantially U-shaped release spring for biasing the button so that the button extends through the release hole of the shank and through the shaft hole to releasably secure the shank to the shaft.

18. A hockey stick assembly, the hockey stick assembly comprising:

a shaft having an outer surface, a blade end and a handle end, the blade end having a side wall, a central bore extending from the blade end towards the handle end and a shall hole extending through the side wall;

an intermediate shank having a shank side wall with an outer diameter, a hollow interior defined by the shank side wall and a release hole extending through the shank side wall, wherein the intermediate shank and the shaft are a nested relationship so that the release hole of the shank is in coaxial alignment with the shaft hole;

a spring-biased release member within the interior of the shank and within the central bore of the shaft, the release member including a button biased so that the button extends through the release hole of the shank and through the shaft hole to releasably secure the shank to the shaft;

a blade having a main blade body portion, a neck portion and an upper lug integrally projecting from the neck portion, wherein the upper lug nests within the interior of the intermediate shank; and means for fixedly mounting the intermediate shank to the upper lug of the blade.

19. The hockey stick assembly of claim 18 wherein the blade includes:

a lower lug integrally projecting from neck portion below the upper lug, the lower lug being sized so that the lower lug forms a shoulder for engaging the intermediate shank and so that the lower lug nests within the central bore of the shaft.

20. A hockey stick assembly, the hockey stick assembly comprising:

a shaft having an outer surface, a blade end and a handle end, the blade end having a side wall, a central bore extending from the blade end towards the handle end and a shaft hole extending through the side wall;

an intermediate shank, wherein the intermediate shank is tubular and has a shank side wall with an outer diameter, a bore extending through the shank and defined by the shank side wall, and a release hole extending through the shank side wall, wherein the intermediate shank and the shaft are in a nested relationship so that the release hole of the shank is in coaxial alignment with the shaft hole;

a spring-biased release member within the interior of the shank and within the central bore of the shaft, the release member including a button biased so that the button extends through the release hole of the shank and through the shaft hole to releasably secure the shank to the shaft;

a blade having a main blade body portion, a neck portion and an upper lug integrally projecting from the neck portion, wherein the upper lug nests within the bore of the intermediate shank; and means for mounting the intermediate shank to the upper lug of the blade.

21. The hockey stick assembly of claim 19 wherein the blade includes:

a lower lug integrally projecting from the neck portion below the upper lug, the lower lug being sized so that the lower lug forms a shoulder for engaging the intermediate shank and so that the lower lug nests within the cavity of the shaft.

* * * * *

UNITED STATES PATENT AND TRADEMARK OFFICE

CERTIFICATE OF CORRECTION

PATENT NO. : 5,447,306

DATED : SEPTEMBER 5, 1995

INVENTOR(S) : SCOTT C. SELDEN

It is certified that error appears in the above-indentified patent and that said Letters Patent is hereby corrected as shown below:

Col. 4, line 61, before 4, delete ","

Col. 6, line 38, delete "Shaft", insert --shaft--

Signed and Sealed this

Twenty-eighth Day of November 1995

*Attest:*

Bruce Lehman

BRUCE LEHMAN

*Attesting Officer*

*Commissioner of Patents and Trademarks*